US006624400B2

(12) United States Patent
Chun

(10) Patent No.: US 6,624,400 B2
(45) Date of Patent: Sep. 23, 2003

(54) MICROWAVE OVEN WITH AN APPARATUS FOR DETECTING LIFE TIME OF COMPONENTS THEREOF

(75) Inventor: Yun-Bong Chun, Seoul (KR)

(73) Assignee: Samsung Electronics Co., Ltd., Suwon (KR)

( * ) Notice: Subject to any disclaimer, the term of this patent is extended or adjusted under 35 U.S.C. 154(b) by 73 days.

(21) Appl. No.: 09/917,221

(22) Filed: Jul. 30, 2001

(65) Prior Publication Data

US 2002/0014486 A1 Feb. 7, 2002

Related U.S. Application Data

(63) Continuation-in-part of application No. 09/487,906, filed on Jan. 19, 2000, now abandoned.

(30) Foreign Application Priority Data

Jan. 20, 1999 (KR) ..... 1999/1656

(51) Int. Cl.[7] ..... H05B 6/68
(52) U.S. Cl. ..... 219/702; 219/723
(58) Field of Search ..... 219/702, 723, 219/719, 710, 720–721, 709, 718, 704–705, 714; 700/83, 15, 17, 207, 211; 709/208; 327/531

(56) References Cited

U.S. PATENT DOCUMENTS 4,005,370 A * 1/1977 Kusunoki et al. ..... 327/531
4,551,601 A * 11/1985 Nishimura ..... 219/710
4,785,152 A * 11/1988 Hirata et al. ..... 219/719
5,081,332 A 1/1992 Sakuragawa
5,837,978 A * 11/1998 Hatzakis, Jr. et al. ..... 219/702
6,121,593 A * 9/2000 Mansbery et al. ..... 219/679
6,175,860 B1 * 1/2001 Gaucher ..... 709/208

FOREIGN PATENT DOCUMENTS

JP 07027341 * 1/1995
JP 08-136672 5/1996
JP 09060886 A * 3/1997
JP 09-146664 6/1997

OTHER PUBLICATIONS

Japanese Patent Office Action in corresponding co–pending Ser. No. 2000–009485, issue No. 201232 dated Jun. 25, 2002.
Chinese Patent Office action dated Sep. 6, 2002.

* cited by examiner

*Primary Examiner*—Quang T. Van
(74) *Attorney, Agent, or Firm*—Robert E. Bushnell, Esq.

(57) ABSTRACT

A microwave oven with an apparatus for detecting life time of components detects a frequency of opening and closing of a door switch even when AC power supply is cut-off, and detects a driving time of a high voltage transformer or a magneton according to their driving status, and accumulates and stores the detected driving time in a memory. The microwave oven includes a high frequency generation detecting portion connected to a high frequency generating portion for detecting driving status of high frequency generating components such as the high voltage transformer or the magnetron, and a door opening/closing detecting portion for detecting opening and closing of the door. A microcomputer counts the driving time of We high frequency components and the frequency of door opening and closing, and accumulates and stores the counted result in the memory. The accumulated result stored in the memory is displayed in as display portion by a key manipulating portion for a notice of a user so that the user can check the driving time of the components.

20 Claims, 6 Drawing Sheets

MICROWAVE OVEN WITH AN APPARATUS FOR DETECTING LIFE TIME OF COMPONENTS THEREOF

This application is a continuation-in-part of Applicant's Ser. No. 09/487,906 filed in the U.S. Patent and Trademark Office on Jan. 19, 2000, now abandoned.

CLAIM OF PRIORITY

This application makes reference to, incorporates the same herein, and claims all benefits accruing under 35 U.S.C. §119 from an application for CONTROL METHOD OF A MICROWAVE OVEN earlier filed in the Korean Industrial property Office on the 20th of January 1999, and there duly assigned Serial No. 1656/1999 by that Office.

BACKGROUND OF THE INVENTION

1. Field of the Invention

The present invention relates to a microwave oven and more particularly to a microwave oven with an apparatus for detecting a life time of components and a method thereof.

2. Description of the Related Art

Generally, a microwave oven includes various components installed therein, and the respective components have life time of predetermined length. Accordingly, when the predetermined length of life time elapses, the microwave oven goes out of order.

When the microwave oven is out of order, a user asks a manufacturer for a repair as an after-sales service, and the manufacturer have the microwave oven repaired by replacing the expired component with a new one.

Meanwhile, the components of the microwave oven usually have different length of life time, respectively. Also, the life time of the components of the microwave oven is usually determined by either total operating time or frequency of use.

Accordingly, if the microwave oven is out of order due to expired component, one cannot expect when the microwave oven will be out of order, since the time will differ one from another Even the microwave ovens of the same kind go out of order in different time, since the expiration time usually depends on any one of the frequency of use and using time by a customer.

Accordingly, whenever the life time of the component expires, the customer cannot use the microwave oven and thus has to bear unexpected inconvenience. For the manufacturer, the manufacturer also has to bear the inconveniences of having to visit the customer to have the microwave oven repaired or to ask the customer to bring the microwave oven to the manufacturer.

Meanwhile, it would be helpful for the development of the microwave oven, if the manufacturer is informed about the preferences of the customers in time. However, there is no way for the manufacturer to check how frequently the microwave oven is used by a certain group of customers for a certain period, or which function of the microwave oven is most frequently used by the customer, or the like, until the repairmen directly checks the microwave oven, the manufacturer cannot reflect the data in the development of the microwave oven.

SUMMARY OF THE INVENTION

The present invention has been made to overcome the above-mentioned problems of the related art, and accordingly, it is an object of the present invention to provide a microwave oven with an apparatus for detecting a life time of components.

Another object of the present invention is to provide a microwave oven enabling a remote check on a life time of components of the microwave oven.

The above object is accomplished by a microwave oven in accordance with the present invention, including a power supply for supplying a power, a key manipulating portion for inputting a time for cooking foodstuff placed in a cooking chamber of the microwave oven, a high frequency generating portion for generating a high frequency microwave for cooking the foodstuff, a door for opening and closing the cooking chamber, a door switch for detecting opening and closing of the door, a life time detecting portion having a high frequency generation detecting portion and a door opening/closing detecting portion, the high frequency generation detecting portion connected to the high frequency generating portion for detecting a driving time of high frequency generating components of the high frequency generating portion, the door opening/closing detecting portion connected to the door switch for detecting opening and closing of the door, a microcomputer connected to the high frequency generation detecting portion and the door open/closing detecting portion for counting and accumulating the driving time and/or a frequency of door opening and closing from the life time detecting portion, a memory for storing the accumulated driving time and the frequency of door opening and closing, and a display portion for displaying the cooking time, the accumulated driving time and/or the frequency of door opening and closing.

According to one aspect of the present invention, the high frequency generation detecting portion includes a photo-coupler connected to the high frequency generating portion for inputting a high frequency generation signal to the microcomputer when the high frequency generating components are driven, while inputting a high frequency generation stop signal to the microcomputer when the high frequency generating components are stopped.

When inputted with the high frequency generation signal through the photo-coupler, the microcomputer operates an internal clock to synchronize the memory, counts the driving time of the high frequency generating components, and accumulates the driving time in a predetermined time unit.

The door opening/closing detecting portion includes a transistor, a base of which being connected to one end of the door, and a resistor, one end of which being connected to a collector of the transistor and to the microcomputer, and the other end of which being applied with a predetermined voltage. The door opening/closing detecting portion inputs a door opening signal to the microcomputer when the door switch is open, while inputting a door closing signal to the microcomputer when the door switch is closed.

The microcomputer increases the frequency of door opening and closing by 1 and accumulates the same when being inputted with the door opening signal and then the door closing signal.

According to another aspect of the present invention, the power supply includes a secondary power supply portion for supplying the power to the microcomputer when AC power from the power supply is cut-off. The secondary power supply portion includes a secondary battery for being charged when the AC power is supplied, while being discharged when the AC power is cut-off.

Another object of the present invention is accomplished by a microwave oven in accordance with the present invention, including a power supply portion for supplying the power, a key manipulating portion for inputting a time for cooking foodstuff placed in a cooking chamber of the microwave oven, a high frequency generating portion for generating a high frequency microwave for cooking the foodstuff, a door for opening and closing the cooking chamber, a door switch for detecting opening and closing of the door, a life time detecting portion having a high frequency generation detecting portion and a door opening/closing detecting portion, the high frequency generation detecting portion connected to the high frequency generating portion for detecting a driving time of high frequency generating components of the high frequency generating portion, the door opening/closing detecting portion connected to the door switch for detecting opening and closing of the door, a microcomputer for counting and accumulating the driving time and/or a frequency of door opening and closing from the life time detecting portion, a memo, for storing the accumulated driving time and the frequency of door opening and closing, a display portion for displaying the cooking time, the accumulated driving time and/or the frequency of door opening and closing, and an external communicating portion connected to the microcomputer and an external device for enabling a communication between the microcomputer and the external device. The microcomputer receives a command inputted from the external device through the key manipulating portion or through the external communicating portion, and display or deletes the accumulated driving time and/or the frequency of door opening and closing stored in/from the memory in accordance with the input command.

In the microwave oven in accordance with the present invention, regardless of the presence of abnormality in the high frequency generating components or the door, since the repairmen can check the accumulated driving time and frequency of door opening and closing while the component upon request of the customer is repaired, the life time of the component can be checked and thus the component can be replaced in due course. Accordingly, requests from the customers is reduced, and the customer does not have to bear the inconveniences of having to wait when need to use the microwave oven.

Also, since communication with a service center via the Internal through the external communicating portion is enabled, the manufacturer can check life time of the components of the microwave oven in advance and could deal with a possible problem well before the customer finds a problem and requests a repairing service. Accordingly, the quality of repairing service is improved, and the reliability about the product and the credibility to the manufacturer also increase.

Further, since the manufacturer can reflect collected data in the product development, more improvement can be expected.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF PREFERRED EMBODIMENTS

Detailed description of the preferred embodiments of the present invention will follow referring to the attached drawings.

Figure 1:
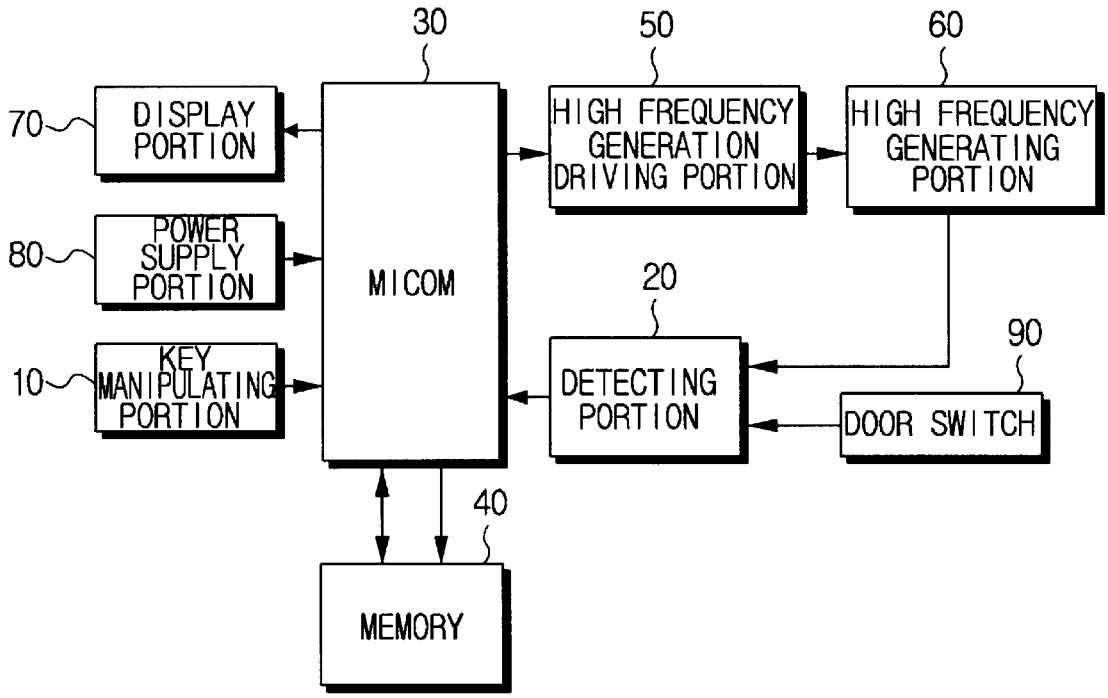
FIG. 1 is a block diagram showing a construction of a microwave oven in accordance with a first preferred embodiment of the present invention.

FIG. 1 is a block diagram showing a microwave oven in accordance with a first preferred embodiment of the present invention. The microwave oven in accordance with the first preferred embodiment of the present invention includes a key manipulating portion 10, a detecting portion 20 a microcomputer 30, a memory 40, a high frequency generation driving portion 50, a high frequency generating portion 60, a door switch 90, a power supply portion 80, and a display portion 70.

The key manipulating portion 10 is formed on a front panel (not shown) of the microwave oven, so that the user can input necessary items required for the operation of the microwave oven such as cooking time and cooking material by pressing a key (not shown) on the key manipulating portion 10.

The high frequency generating portion 60 generates a high frequency of microwaves for cooking foodstuff placed in a cooking chamber of the microwave oven, and includes a magnetron (not shown) that is driven by the high frequency generation driving portion 50. The number of the magnetron varies depending on a type of the microwave oven, and in this embodiment, two magnetrons, i.e., first and second magnetrons (not shown) will be used.

The high frequency generation driving portion 50 supplies high voltage to the high frequency generating portion 60 by a high voltage transformer (not shown) equipped in the high frequency generation driving portion 50. The number of high frequency generation driving portion 50 corresponds to the number of magnetrons, and accordingly, there will be two, i.e., first and second transformers (not shown) used in this embodiment.

The detecting portion 20 detects operation of the components such as the door switch 90, the first and the second high voltage transformers of the high frequency generation driving portion 50, or the first and the second magnetrons of the high frequency generating portion 60, and the detected result is inputted to the microcomputer 30.

Figure 2:
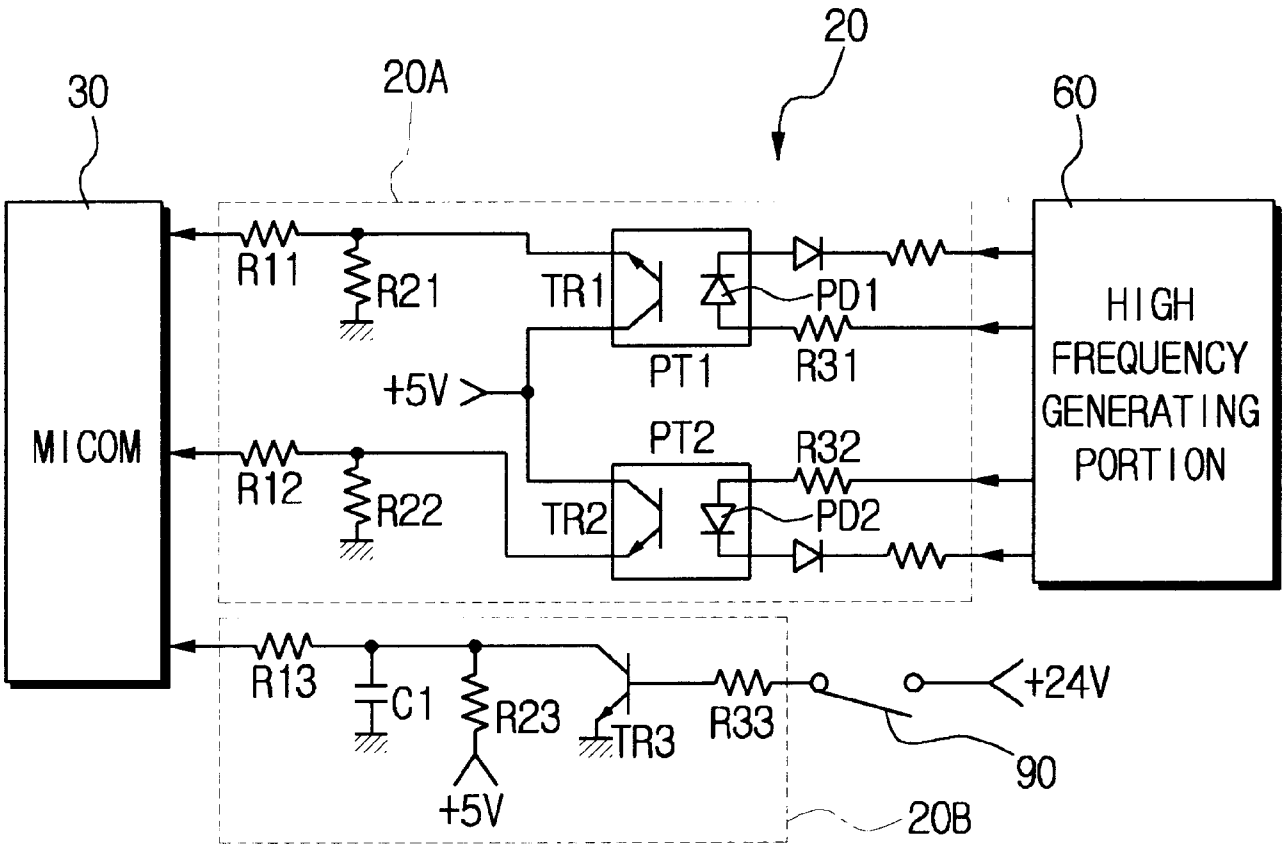
FIG. 2 is a view showing a detecting portion of FIG. 1 in greater detail.

As shown in FIG. 2, the detecting portion 20 includes a high frequency generation detecting portion 20A for detecting driving status of the first and the second high voltage transformers and the first and the second magnetrons, and a door opening/closing detecting portion 20B for detecting opening and closing of the door.

As shown in FIG. 2, the high frequency generation detecting portion 20A includes photo-diodes PD1 and PD2 connected to the high frequency generating portion 60, phototransistors TR1 and TR2 turned on by radiation of the photo-diodes PD1 and PD2, resistors R11 and R12 connected between emitters of the photo-transistors TR1 and TR2 and the microcomputer 30, and resistors R21 and R22 grounded between the photo-transistors TR1 and TR2 and the resistors R11 and R12.

Collectors of the photo-transistors TR1 and TR2 are connected with each other, and are applied with voltage of +5V. The high frequency generation detecting portion 20A includes two high frequency generation detecting circuits connected with each other. Each high frequency generation detecting circuit is constructed by a photo-diode PD1, a photo-transistor TR1 a resistor R11, and a resistor R21. Accordingly, in case the number of magnetron and high voltage transformer are three, respectively, there are three high frequency generation detecting circuits connected, to thereby construct the high frequency generation detecting portion in the microwave oven that has three magnetrons and three high voltage transformers.

The photo-diodes PD1 and PD2 of the high frequency generation detecting portion 20A construct photo-couplers PT1 and PT2 in association with the photo-transistors TR1 and TR2. The photo-couplers PT1 and PT2 can be anything that could apply 'HIGH' signal to the microcomputer 30 during the operation of the high frequency generating portion 60, and apply 'LOW' signal to the microcomputer 30 when the high frequency generating portion 60 is stopped. For example, a relay could be the photo-coupler.

When the high frequency microwaves are generated by the high frequency generating portion 60, for example, when the first high voltage transformer and the first magnetron are driven, the resistors R31 and R32 and the photo-diodes PD1 and PD2 are applied with electric voltage. At this time, electric current flows the resistors R31 and R32, the radiation is emitted from the photo-diodes PD1 and PD2. By the radiation of the photo-diodes PD1 and PD2, the electric current flows from the collectors to the emitters of the photo-transistors TR1 and TR2 (i.e., switching on). By the switching on of the photo-couplers PT1 and PT2, the microcomputer 30 is inputted with the 'HIGH' signal, and accordingly detects that the high frequency generating portion 60 is driven. At this time, by operating and synchronizing a clock, the microcomputer 30 counts the driving time of the first and the second magnetrons and the first and the second high voltage transformers.

Meanwhile, the door opening/closing detecting portion 20B includes the transistor TR3 act whose base is connected to one end of the door switch 90 through the resistors R33, the resistor R13 connected between the collector of the transistor TR3 and the microcomputer 30, and a capacitor C I and the resistor R23 connected between the resistor R13 and the emitter of the transistor TR3. The resistor R23 is applied with the voltage of +5V. The other end of the door switch 90 is applied with the voltage of +24V.

When the door of the microwave oven is open by a user, as shown in FIG. 2, the door switch 90 is short-circuited. Since there is no voltage applied to the base of the transistor TR3, the microcomputer 30 is applied with the voltage of +5V, i.e., the 'HIGH' signal through the resistors R23 and R13, and thus detects that the door of the microwave oven is open. When the door of the microwave oven is closed, the door switch 90 is closed, and the voltage of +24V is applied to the base of the transistor TR3 through the resistor R33. Accordingly, electric current flows through the resistor R23, the collector of the transistor TR3, and the emitter of the transistor T3, and the microcomputer 30 is applied with the 'LOW' signal. As described above, according to the opening and closing of the door of the microwave oven, the 'HIGH' and 'LOW' signals are applied to the microcomputer 30 sequentially, and the microcomputer 30 detects that the door of the microwave oven is opened and closed once.

As the memory 40, an EEPROM (Electrically Erasable and Programmable Read Only Memory) having capacity of 41 Kbit is used. In the memory 40, information or data processed by the microcomputer 30, i.e., driving time of the high voltage transformers and the magnetrons and a frequency of door opening/closing, counted by the microcomputer 30, are accumulated and stored. The total accumulated driving time of the high voltage transformers and/or magnetrons and/or the frequency of opening/closing of the door switch 90 stored in the memory 40, are displayed in the display portion 70 by the manipulation of the key of the key manipulating portion 10.

The memory 40, i.e., the EEPROM is written with data in a certain address during the manufacturing process, and mounted on a printed circuit board of the microwave oven. In order to check if the EEPROM is mounted on the printed circuit board accurately, the written data is read by using proper equipments. If the read data identifies with the written data, it is judged that the EEPROM is mounted on the printed circuit board accurately.

An input and output ports of the microcomputer 30 are connected to input and output ports of the memory 40, in a manner of permitting bi-directional communication therebetween. A clock terminal of the memory 40 is connected to a clock terminal of the microcomputer 30, and accordingly a constant pulse is supplied from the microcomputer 30 to the memory 10. Accordingly, the microcomputer 30 and the memory 40 are operated at the same time. In other words, the microcomputer 30 and the memory 40 are synchronized with each other.

A liquid crystal display (LCD) can be used as the display portion 70, which displays information or data stored in the memory 40 in the form of text or symbols recognizable by the user under the control of the microcomputer 30.

Figure 3:
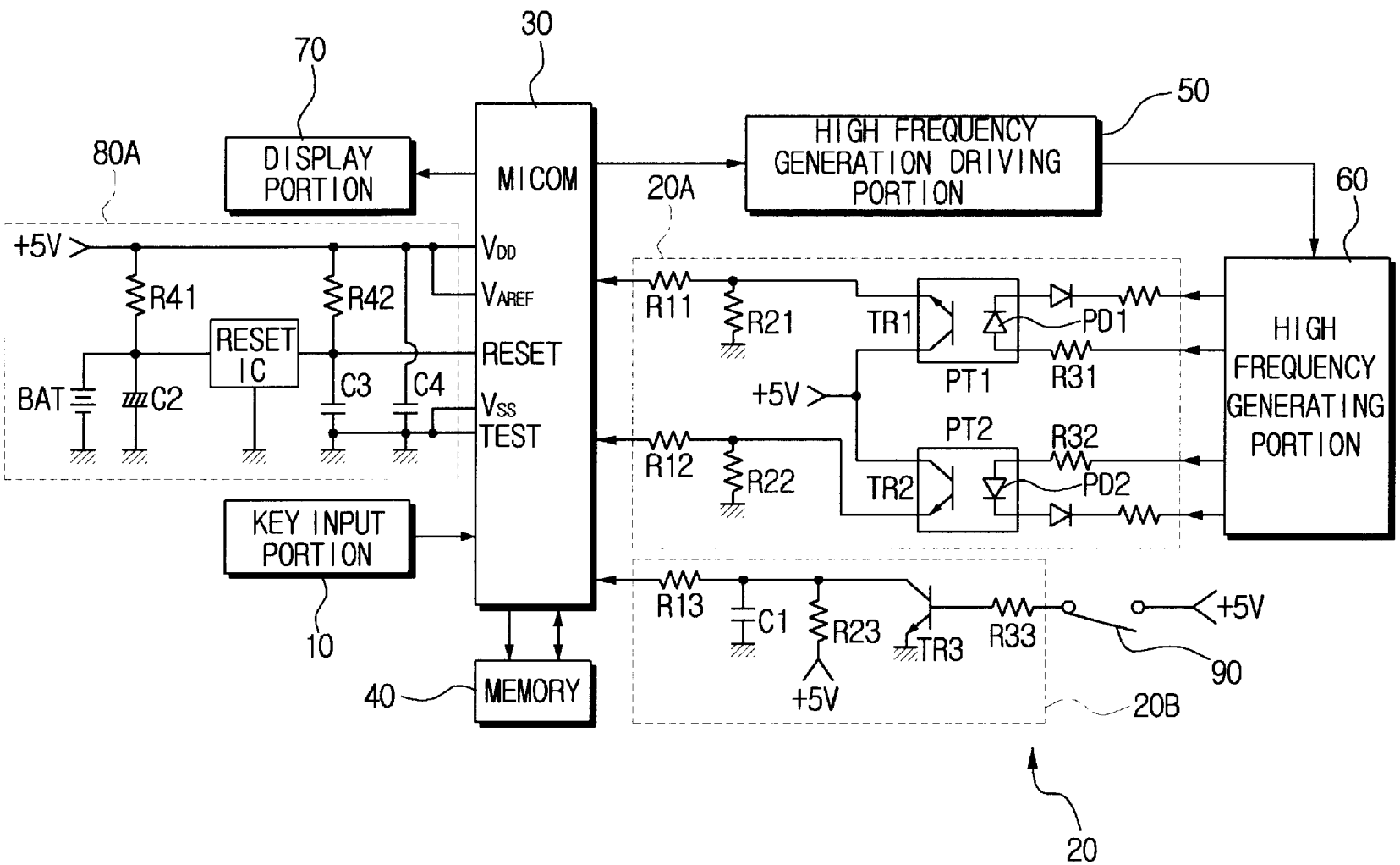
FIG. 3 is a block diagram showing the construction of a microwave oven in accordance with a second preferred embodiment of the present invention.

FIG. 3 is a view showing the construction of the microwave oven in accordance with the second preferred embodiment of the present invention. The microwave oven in accordance with the second preferred embodiment of the present invention is almost identical with the microwave oven in accordance with the first preferred embodiment, except for the presence of a power supply portion 80 and the level of voltage applied to the other end of the door switch 90. Accordingly, the same reference numerals will be given to the identical or similar elements of the second preferred embodiment, and the description will be made only about the distinguishing portions of the second embodiment, i.e., about the power supply portion 80A and the door switch 90.

Like the microwave oven in accordance with the first preferred embodiment of the present invention, the microwave oven is usually driven by AC power. In the microwave oven in accordance with the first preferred embodiment, without the AC power supply, the microcomputer 30 is not driven, which means the opening/closing of the door switch 90 cannot be detected, neither.

In order to improve the above disadvantage, in the microwave oven in accordance with the second preferred embodiment of the present invention, the other end of the door switch 90 is applied with the voltage of +5V, and a power supply portion 80A serves as a backup power supply that could supply power to the microcomputer 30 when the AC power supply to the microwave oven is cut.

The power supply portion 80A includes a battery BAT for converting the AC power into DC power and applying the DC power to the microcomputer 30 as a driving power when AC power is applied from the regular power supply portion 80, and also applying the driving power to the microcomputer 30 by being discharged when the AC power is cut off, and a stabilizing circuit connected with the battery BAT for stabilizing the voltage discharged from the battery BAT.

As shown in FIG. 3, the power supply portion 80A includes a power line through which converted AC power of +5V is applied, a resistor R41 connected between the power line and the battery BAT, an electrolytic capacitor C2 connected in parallel with the battery BAT to construct a charge/discharge circuit with the battery BAT, a reset IC having one end connected with the battery BAT and the electrolytic capacitor C2 to initialize the microcomputer 30, a resistor R42 having one end connected to the power line and the other end connected to the reset IC, a capacitor C3 connected to the resistor R42 and the reset IC, and a capacitor C4 having one end connected to the resistor R42 and the other end connected to the other end of the capacitor C3. The resistor R42, and the capacitors C3 and C4 construct the stabilizing circuit.

When the converted AC power, i.e., the voltage of +5V is applied through the power line, the battery BAT is charged, and the stabilizing circuit supplies a stabilized and constant voltage to the microcomputer 30. Then when a power plug of the microwave oven is pulled out from a receptacle formed on a wall, AC power is not supplied to the microwave oven. At this time, the battery BAT is discharged, applying the voltage of +5V to the microcomputer 30. Accordingly, in the microwave oven in accordance with the second preferred embodiment of the present invention, even when the AC power supply is cut off, the opening and closing of the door switch 90 can be detected. In other words, even without the power supply, the frequency of the opening and closing of the door switch 90 can be detected and accumulated.

Figure 6:
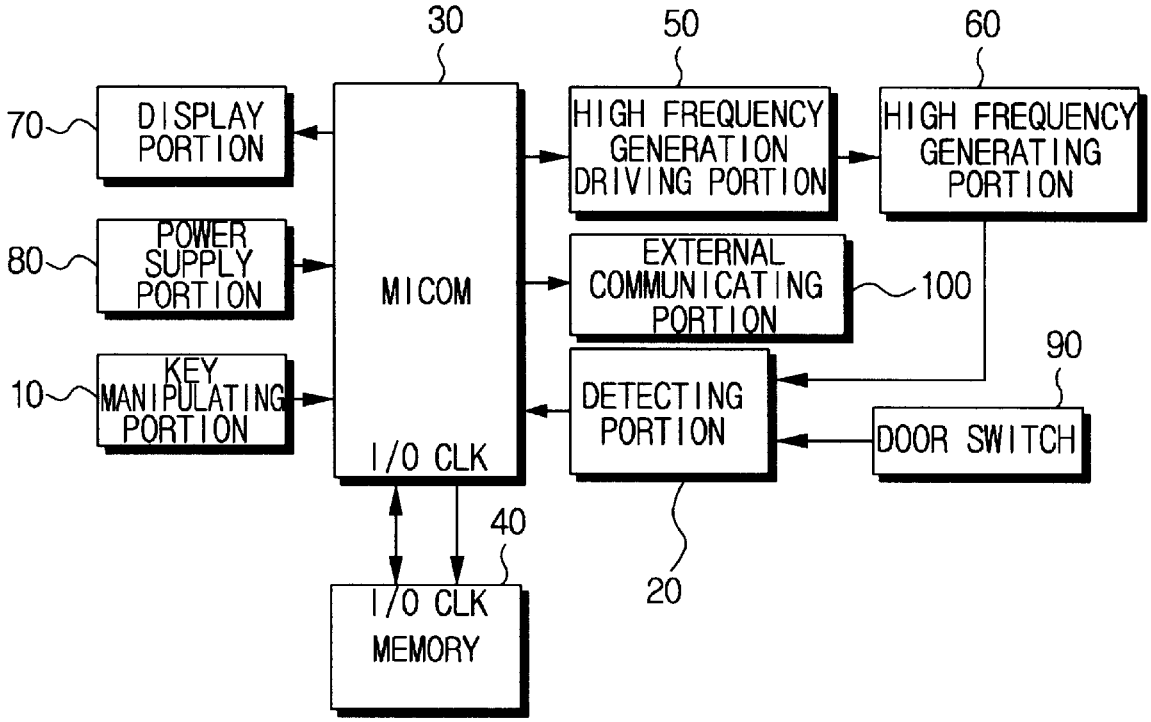
FIG. 6 is a block diagram showing the construction of a microwave oven in accordance with a third preferred embodiment of the present invention.

FIG. 6 is a block diagram showing the microwave oven in accordance with the third preferred embodiment of the present invention. As shown in FIG. 6, the microwave oven in accordance with the third preferred embodiment of the present invention is almost identical with the microwave oven in accordance with the first and the second preferred embodiments, except for the presence of an external communicating portion 100 for inputting and outputting signal to and from the microcomputer 30. Accordingly, in the following description, the distinguishing portion of the third preferred embodiment, i.e., the external communicating portion 100 will be described.

As shown in FIG. 6, the external communicating portion 100 is one of input/output terminals connectable to the microcomputer 30. A repairman from the manufacturer can communicate with the microcomputer 30 uni-directionally or bi-directionally by connecting his/her equipment to the external communicating portion 100. Also, without having to use the key manipulating portion 10, the repairmen can display in the display portion 70 or in his/her equipment the total driving time of the high voltage transformer or magnetron and/or a frequency of use of the door switch 90 accumulated and stored in the memory 40 by inputting a command in the microcomputer 30. The external communicating portion 100 may be provided to the front panel of the microwave oven, or mounted on the printed circuit board within a component chamber (not shown) of the microwave oven.

Further, the external communicating portion 100 may use a serial port such as a RS232C, or a universal serial bus, and can be connected to the external devices through a model-installed computer connected to the Internet. Alternatively, the model can be installed in the microwave oven so that the microwave oven can access the external devices.

Figure 4:
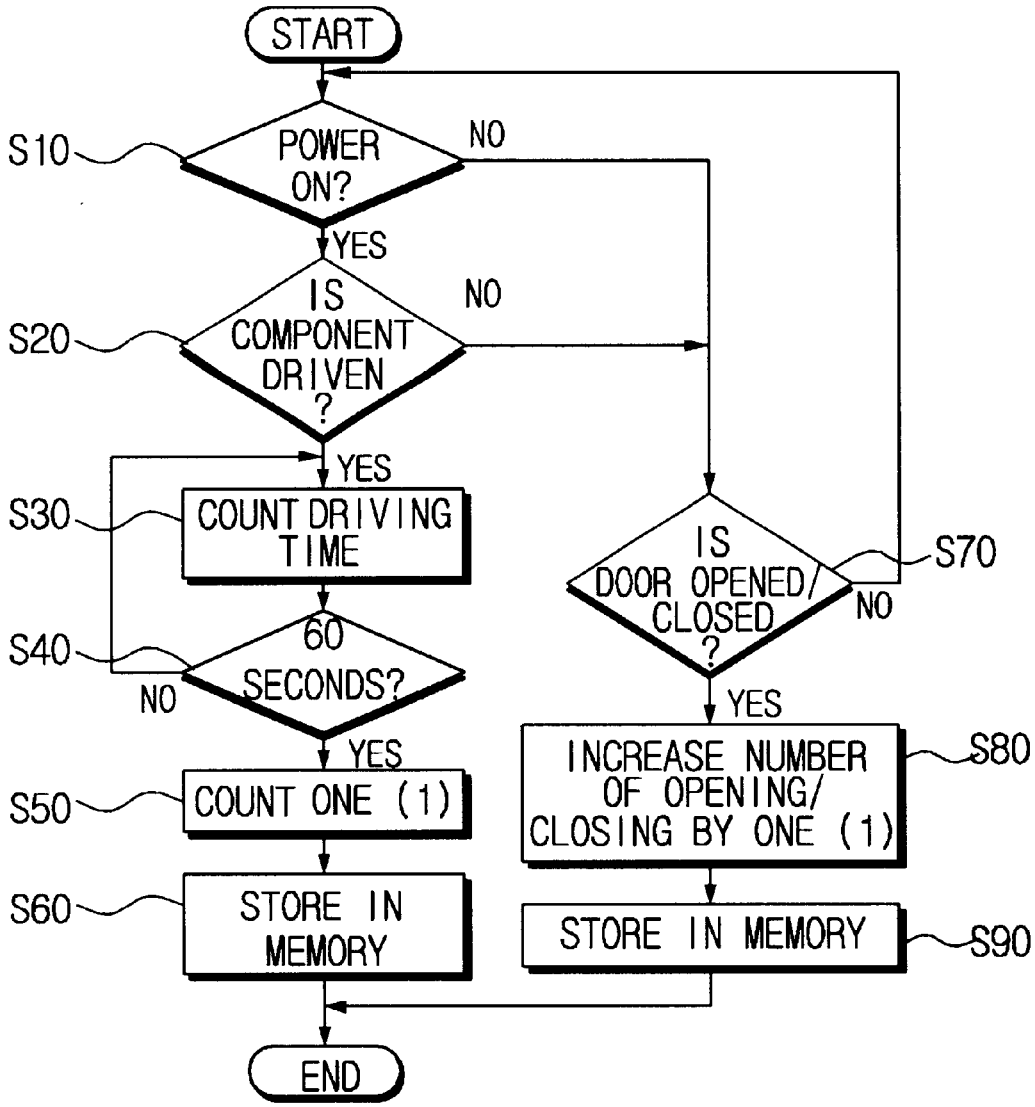
FIG. 4 is a flowchart explaining a process of detecting a life time of the microwave oven in accordance with the present invention.

FIG. 4 is a flowchart for explaining a process for detecting a life time of the components of the microwave oven in accordance with the first, the second, and the third preferred embodiments of the present invention. Below, by referring to FIG. 4, the process for detecting the life time of components in the microwave oven by accumulating and storing total driving time and/or total frequency of use of the components of the microwave oven in accordance with the first, the second, and the third preferred embodiments of the present invention will be described.

The detecting process includes a process for detecting driving time of high frequency generating components such as high voltage transformer, or magnetron, and a process for detecting a frequency of opening and closing of the door switch.

The process for detecting the driving time of the high frequency generating components includes the steps of determining whether the high frequency generating components are driven or not (step S20), counting the driving time of the high frequency generating components (step 530), determining whether the counted driving time reaches a predetermined time unit (e.g., 60 seconds) (step 540), when the driving time reaches the predetermined time unit, counting the driving time as the predetermined time unit (step S50), and storing the counted predetermined time unit (step S60).

Meanwhile, the process for detecting a frequency of opening and closing of the door switch includes the steps of determining whether the door of the microwave oven is open or closed (step S70) when the door is open or closed, increasing the value of frequency of door opening and closing by 1 and accumulating the increased value (step S80), and storing the accumulated door opening and closing frequency (step S90).

The operation of the microwave oven in accordance with the first, the second, and the third preferred embodiments of the present invention will be described below, with the description of the process for detecting the life time of the components of the microwave oven.

First, the microcomputer 30 determines whether AC power is supplied to the microwave oven through the power supply portion 80A or not (step S10). When there is no supply of AC power, the battery BAT is discharged, applying driving power to the microcomputer 30. This process is also performed in the microwave oven in accordance with the second and the third preferred embodiments of the present invention, while in the microwave oven in accordance with the first preferred embodiment of the present invention, the microcomputer 30 is not operated.

At this time, if the door is open, i.e., if the door switch 90 is open, since electric current does not flow through the collector and emitter of the transistor TR3, the microcomputer 30 is applied with the voltage of +5V (i.e., 'HIGH' signal), and accordingly, the microcomputer 30 detects the opening of the door.

Meanwhile, when the door is closed, i.e., when the door switch 90 is closed, in the microwave oven in accordance with the first preferred embodiment, the voltage of +24V is applied to the base of the transistor TR3, while in the microwave oven in accordance with the second preferred embodiment, the voltage of +5V is applied to the base of the transistor TR3. Accordingly, electric current flows from the collector to emitter of the transistor TR3, and the microcomputer 30 is applied with the voltage of 0V (i.e., 'LOW' signal). Accordingly, the microcomputer 30 detects the closing of the door.

As the door is open and closed once, the microcomputer increases the frequency of door opening and closing by one (1) (step S80), and increases accumulated value of the frequency in the memory 40 by one (1) and stores the result in the memory 40 (step S90).

Meanwhile, when AC power is supplied to the microwave oven, the microcomputer 30 determines whether the high frequency generating components are driven or not, through the high frequency generation detecting portion 20A (step S20). If there is no high frequency generating component driven, the process for detecting the frequency of door opening and closing (S70 through S90) is performed.

When one or both of the pair of first high frequency transformer and the first magnetron, and the second high frequency transformer and the second magnetron is driven, i.e., when one or both of the first and the second magnetrons generate high frequency microwaves, half-wave electric current flows the photo-diodes PD1 and PD2. By the half-wave electric current, the photo-diode PD1 and PD2 emit the radiation, and the photo-transistors TR1 and TR2 are turned on. Accordingly, the voltage, applied to the collectors of the photo-transistors TR1 and TR2, is applied to the microcomputer 30 through the resistors R11 and R13. In other words, the microcomputer 30 is applied with the 'HIGH' signal, and accordingly detects that the high frequency generating components are driven (step S20).

At this time, the microcomputer 30 operates the clock CLK, synchronizes the memory 40, and counts the driving time of the high frequency generating components (step S30). Continuously, the microcomputer 30 determines whether the counted driving time reaches a predetermined time unit, e.g., whether the counted driving time reaches sixty (60) seconds or not (step S40), If the counted driving time is determined to have reached sixty seconds, the microcomputer 30 counts the driving time in a unit of one minute and accumulates the same (step S50). If the driving time is determined to have not reached the predetermined time unit, the microcomputer 30 keeps counting the driving time until the driving time reaches the sixty seconds.

Meanwhile, in the process for detecting high frequency generating time (S20 through S60), if the door is open, the steps S20 through S60 are interrupted, and accordingly, the counted driving time is stored in the memory 40, and the process for detecting frequency of door opening and closing (S70 through S90) are performed.

The high frequency generation detecting portion 20A and the process for detecting the high frequency generating time (S20 through S60) can also be used to detect the driving time, i.e., the life time of other components, that could generate voltage by being driven, such as a lamp, a motor, a heater that is secondarily used during the cooking process, or the like.

The door opening/closing detecting portion 20B and the process for detecting frequency of door opening and closing (S70 through S90) can also be used to detect a frequency of using other components. For example, the door opening/closing detecting portion 20B and the process for detecting frequency of door opening and closing (S70 through S90) can also be used to detect a frequency of using the key of the key manipulating portion 10. In this case, instead of the door switch 90, a key of the key manipulating portion 10 in the form of a push button switch is connected to the base of the transistor TR3 of the key manipulating portion 10. Further, instead of detecting the frequency of opening and closing of the door as once by the process S70 through S90, one use of the key is detected whenever the key is pressed once.

Figure 5:
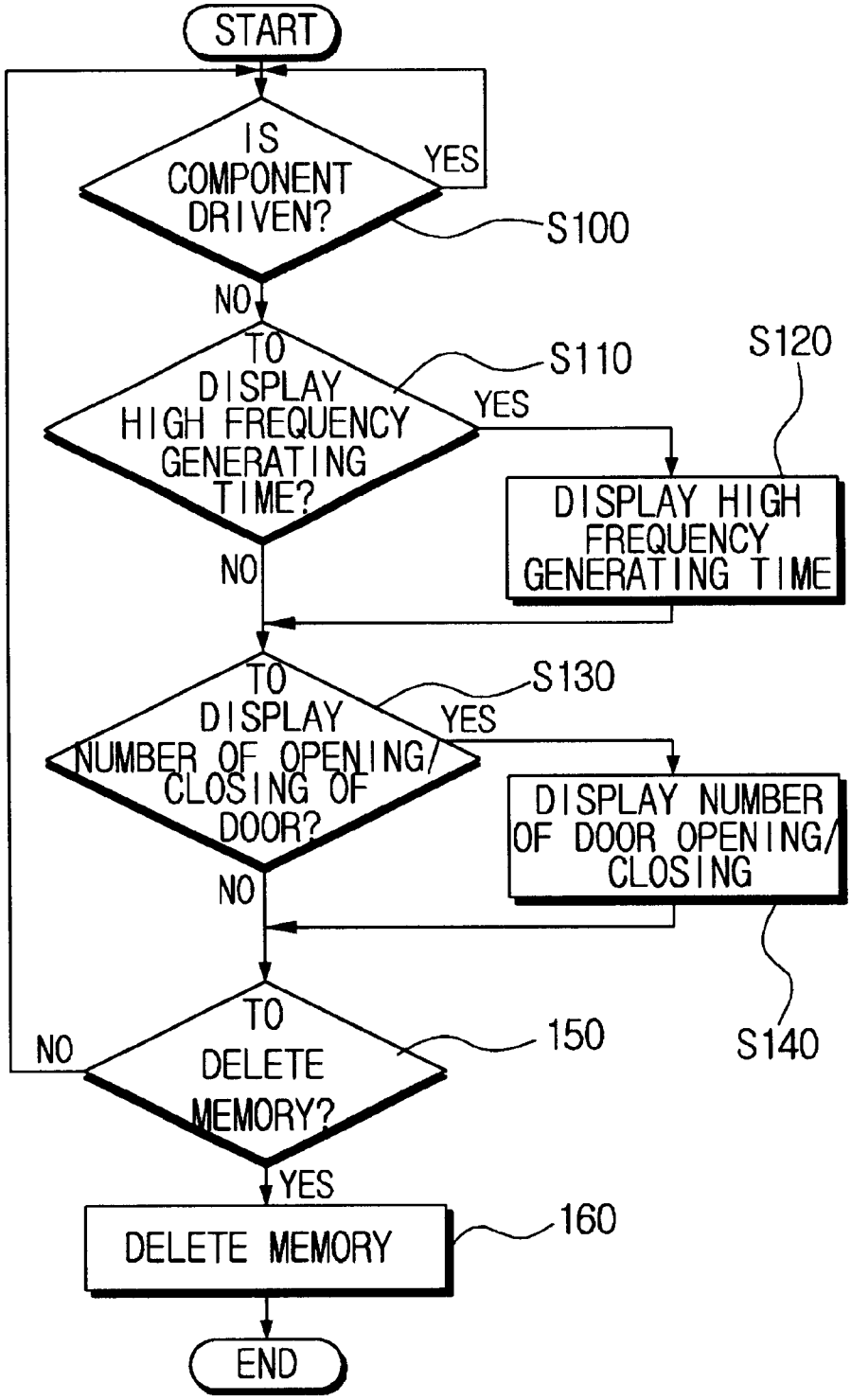
FIG. 5 is a flowchart explaining a process of displaying a total driving time and/or frequency of use of a component detected by the detecting portion and accumulated in a memory in accordance with the present invention.

FIG. 5 is a flowchart for explaining a process of displaying driving time of the high frequency generating components and/or frequency of door opening and closing detected in the microwave oven in accordance with the first, the second, and the third preferred embodiments of the present invention. The process can either be performed by key input through the key manipulating portion 10, or performed by an external device connected to the external communicating portion 100 in accordance with the third preferred embodiment.

With AC power being applied (in accordance with the first preferred embodiment), or cut off (in accordance with the second and the third preferred embodiments) with respect to the microwave oven, the microcomputer 30 determines whether the high frequency generating components are driven or not through the detecting portion 20 (step S100). If there is no high frequency generating component being driven, it is determined whether a predetermined signal for requesting display of driving time of the high frequency generating component accumulated and stored in the memory 40 has been input from the repairmen (operator) through the external device connected to the external communicating portion 100 (step S110).

When the predetermined signal is input to the microcomputer 30, the microcomputer either displays the total value of driving time of the high frequency components accumulated and stored in the memory 40 in the display portion 70, or transmits the same to the external device through the external communicating portion 100 (step S120).

Meanwhile, the microcomputer 30 determines whether there is any signal for requesting display of total value of frequency of door opening and closing has been inputted from the external device through the key manipulating portion 10 or through the external communicating portion 100 (step S130). When the signal for requesting the display of total value of the frequency of door opening and closing is inputted, the microcomputer 30 either displays or transmits to the external device the total frequency of door opening and closing accumulated and stored in the memory 40 (step S140).

Next, the microcomputer 30 determines whether there is a signal for requesting a deletion of the total value of driving time of the high frequency generating components and/or the frequency of door opening and closing from the memory 40 (step S150). When the signal requesting deletion is inputted, the microcomputer 30 deletes the total value of driving time or the frequency of door opening and closing from the memory (step S160).

That is, it is programmed that a signal, requesting display of the total value of driving time of the first high voltage transformer and the first magnetron, is inputted by pressing number "1" key in a state of pressing the "0" key of the key manipulating portion 10, and a signal requesting display of the total value of driving time of the second high voltage transformer and the second magnetron, is inputted by pressing number "2" key in a state of pressing the "0" key of the key manipulating portion 10, and a signal, requesting display of the frequency of door opening and closing, is inputted by pressing number "3" key in a state of pressing the "0" key of the key manipulating portion 10.

Further, as for deletion of the total value of the driving time of the high frequency generating components and the frequency of door opening and closing from the memory 40, the following program is used.

That is, it is programmed in a manner that, the total driving time of the first voltage transformer and the first magnetron accumulated in the memory 40 is deleted from the memory 40 by simultaneously pressing the keys "0", "4", and "1" of the key manipulating portion 10, and the total driving time of the second voltage transformer and the second magnetron accumulated in the memory 40 is deleted from the memory 40 by simultaneously pressing the keys "0", "4", and "2" of the key manipulating portion 10, and the frequency of door opening and closing accumulated in the memory 40 is deleted from the memory 40 by simultaneously pressing the keys "0", "8", and "9" of the key manipulating portion 10.

It should be understood, however, that the above combination of the keys for inputting the signal that requests display or deletion of the driving time and the frequency of the door opening and closing is described just as one example and can be modified by the manufacturer of the microwave oven as necessary.

Since the signal input with the external device connected to the external communicating portion 100 can vary depending to the type of the external device, the description thereof will be omitted.

Meanwhile, the total driving time and the frequency of door opening and closing are deleted from the memory 40 after the replacement of the component by the repairmen. This is because, the driving time or the frequency of door opening and closing is no more necessary after the replacement of the component.

As described above, in the microwave oven in accordance with the present invention, regardless of the presence of abnormality in the high frequency generating components or the door, since the repairmen can check the accumulated driving time and frequency of door opening and closing while the component upon request of the customer is repaired, the life time of the component can be checked and thus the component can be replaced in duo course.

Also, by communicating with the microwave oven through the external communicating portion connected to the Internet, the manufacturer or the repairman can check the remaining life time of the components and accordingly deals with it. Accordingly, requests from the customers is reduced, and the customer does not bear the inconveniences of having to wait when need to use the microwave oven.

Further, by notifying the customer about proper time for replacement of certain component well before the customer finds the problem and requests the repair service, the customer can use the microwave oven conveniently, and thus, the reliability on the microwave oven, manufacturer, and repairing service is improved.

Further, since the manufacturer analyzes and reflects information about use of the microwave oven on the development of the microwave oven, more improvement and advancement can be expected.

Although the preferred embodiments of the present invention have been described, it will be understood by those skilled in the art that the present invention should not be limited to the described preferred embodiments, but various changes and modifications can be made within the spirit and scope of the present invention as defined by the appended claims.

What is claimed is:

1. A microwave oven comprising:

a power supply for supplying a power;

a key manipulating portion for inputting a time for cooking foodstuff placed in a cooking chamber of the microwave oven;

a high frequency generating portion for generating a high frequency microwave for cooking the foodstuff;

a door for opening and closing the cooking chamber;

a door switch for detecting opening and closing of the door;

a life time detecting portion having a high frequency generation detecting portion and a door opening/closing detecting portion, the high frequency generation detecting portion connected to the high frequency generating portion for detecting a driving time of high frequency generating components of the high frequency generating portion, the door opening/closing detecting portion connected to the door switch for detecting opening and closing of the door;

a microcomputer for counting and accumulating at least one of the driving time and a frequency of door opening and closing detected by the life time detecting portion;

a memory for storing the accumulated driving time and the frequency of door opening and closing; and a display portion for displaying the stored driving time and the frequency of door opening and closing.

2. The microwave oven of claim 1, wherein the high frequency generation detecting portion comprises a photocoupler connected to the high frequency generating portion for inputting a high frequency generation signal to the microcomputer when the high frequency generating components are driven, while inputting a high frequency generation stop signal to the microcomputer when the high frequency generating components are stopped.

3. The microwave oven of claim 2, the number of photocoupler is identical to the number of the high frequency generating components.

4. The microwave oven of claim 2, wherein the microcomputer, being inputted with the high frequency generation signal, operates a clock to synchronize the memory, counts the driving time of the high frequency generating components, and accumulates the driving time in a predetermined time unit.

5. The microwave oven of claim 1, wherein the door opening/closing detecting portion comprises:

a transistor, a base of which being connected to one end of the door; and a resistor, one end of which being connected to a collector of the transistor and to the microcomputer, and the other end of which being applied with a predetermined voltage, the door opening/closing detecting portion inputting a door opening signal to the microcomputer when the door switch is open, while inputting a door closing signal to the microcomputer when the door switch is closed.

6. The microwave oven of claim 5, wherein the microcomputer increases the frequency of door opening and closing by 1 and accumulates the same when being inputted with the door opening signal and then the door closing signal.

7. The microwave oven of claim 1, wherein the power supply comprises a secondary power supply portion for supplying the power to the microcomputer when AC power from the power supply is cut-off.

8. The microwave oven of claim 7, wherein the secondary power supply portion comprises a secondary battery for being charged when the AC power is supplied, while being discharged when the AC power is cut-off.

9. A microwave oven comprising:

a power supply for supplying a power;

a key manipulating portion for inputting a time for cooking foodstuff placed in a cooking chamber of the microwave oven;

a high frequency generating portion for generating a high frequency microwave for cooking the foodstuff;

a door for opening and closing the cooking chamber;

a door switch for detecting opening and closing of the door;

a life time detecting portion having a high frequency generation detecting portion and a to door opening/closing detecting portion, the high frequency generation detecting portion connected to the high frequency generating portion for detecting a driving time of high frequency generating components of the high frequency generating portion, the door opening/closing detecting portion connected to the door switch for detecting opening and closing of the door;

a microcomputer for counting and accumulating the driving time and the frequency of door opening and closing from the life time detecting portion;

a memory for storing the accumulated driving time and the frequency of door opening and closing;

a display portion for displaying the cooking time, the accumulated driving time and the frequency of door opening and closing; and an external communicating portion connected to the microcomputer and an external device for enabling a communication between the microcomputer and the external device.

10. The microwave oven of claim 9, wherein the microcomputer receives a command inputted from the external device, and carries out said command wherein said command comprises displaying or deleting at lease one of the accumulated driving time and the frequency of door opening and closing stored in the memory in accordance with the input command.

11. The microwave oven of claim 9, wherein the external communicating portion is connected to the external device via the Internet.

12. The microwave oven of claim 11, wherein the external communicating portion comprises a RS232C.

13. The microwave oven of claim 11, wherein the external communicating portion comprises a universal serial bus (USB).

14. A microwave oven, comprising:

a power supply comprising a primary power supply for supplying a primary power;

a key pad comprising setting keys;

a high frequency generator generating a high frequency microwave;

a door for opening and closing a cooking chamber;

a first detector detecting a use of a first component which does not require an electrical power to operate, said first detector generating a first signal;

a second detector detecting a use of a second component which requires an electrical power to operate, said second detector generating a second signal;

a microcomputer receiving said first signal and said second signal, said microcomputer counting and accumulating said first signal to obtain a first value and said second signal to obtain a second value, said first value comprising at least one of an operating time and a frequency of use of said first component, said second value comprising at least one of an operating time and a frequency of use of said second component;

a memory storing said first value and said second value; and a display displaying said first value and said second value.

15. The microwave oven of claim 14, wherein said first component is the door, said first detector comprises a door switch, and said first value comprises a frequency of use of said door.

16. The microwave oven of claim 15, wherein said first detector further comprises:

a transistor, a base of which being connected to the door; and a resistor, one end of which being connected to a collector of the transistor and to the microcomputer, the other end of which being applied with a predetermined voltage.

17. The microwave oven of claim 14, wherein said second component is the high frequency generator, said second detector is connected to the high frequency generator, and said second value comprises the operating time of the high frequency generator.

18. The microwave oven of claim 17, wherein said second detector further comprises:

a photo-coupler connected to the high frequency generator for inputting a high frequency generation signal to the microcomputer when the high frequency generator is driven, while inputting a high frequency generation stop signal to the microcomputer when the high frequency generator is stopped.

19. The microwave oven of claim 14, wherein said power supply further comprises a secondary power supply for supplying the power to the microcomputer when said primary power is not supplied so that the use of said first component may be detected by said first detector.

20. The microwave oven of claim 14, wherein said display is an external device connectable to microcomputer via at least one of a terminal and Internet.

* * * * *